US010307318B2

(12) United States Patent
Villarreal Garza

(10) Patent No.: US 10,307,318 B2
(45) Date of Patent: Jun. 4, 2019

(54) SURGICAL SUPPORTING DEVICE FOR THE ALIGNMENT OF THE FOOT, ANKLE, LEG, KNEE, THIGH AND FULL LEG

(71) Applicant: Mauricio Villarreal Garza, Monterrey (MX)

(72) Inventor: Mauricio Villarreal Garza, Monterrey (MX)

( * ) Notice: Subject to any disclaimer, the term of this patent is extended or adjusted under 35 U.S.C. 154(b) by 51 days.

(21) Appl. No.: 14/650,024

(22) PCT Filed: Nov. 8, 2013

(86) PCT No.: PCT/MX2013/000135
§ 371 (c)(1),
(2) Date: Jun. 5, 2015

(87) PCT Pub. No.: WO2014/088387
PCT Pub. Date: Jun. 12, 2014

(65) Prior Publication Data

US 2015/0297436 A1 Oct. 22, 2015

(30) Foreign Application Priority Data

Dec. 6, 2012 (MX) ..... MX/a/2012/014311

(51) Int. Cl.
*A61G 13/12* (2006.01)
*A61G 13/00* (2006.01)

(52) U.S. Cl.
CPC ..... *A61G 13/125* (2013.01); *A61G 13/0036* (2013.01); *A61G 13/1245* (2013.01); *A61G 13/1295* (2013.01); *A61G 2200/56* (2013.01); *A61G 2200/58* (2013.01)

(58) Field of Classification Search
CPC ..... A61G 13/00; A61G 13/12; A61G 13/125; A61G 13/0036; A61G 13/1245; A61G 13/1295; A61G 2200/58; A61G 2200/56; A61F 5/01; A61F 5/0111; A61F 5/0127; A61F 5/0174; A61H 1/00; A61H 1/0237; A61H 1/0266
See application file for complete search history.

(56) References Cited

U.S. PATENT DOCUMENTS 3,511,233 A * 5/1970 Elbert, Jr. ..... A61F 13/069 128/892
3,931,654 A * 1/1976 Spann ..... A61G 7/0755 5/650
4,474,176 A * 10/1984 Farris ..... A61H 1/0266 601/27

(Continued)

*Primary Examiner* — Peter M. Cuomo
*Assistant Examiner* — David R Hare
(74) *Attorney, Agent, or Firm* — Law Office of William F. Ryann

(57) ABSTRACT

Providing a surgical support instrument for the alignment of the lower extremities comprising modular elements which provides an excellent and not invasive tool that may allow to obtain a 90 degree angle on the foot's sole vs. full leg (upper thigh, knee, leg, ankle and foot) and vice versa, as well as 90 degrees on the foot's sole vs. lower leg (lower leg, ankle and foot) and vice versa. The term patient's lower extremities alignment mainly refers to, but not exclusively, Ankle, Foot and Knee, and such alignment may help the surgeon to achieve a higher success rate on the surgery procedure.

18 Claims, 4 Drawing Sheets

(56) References Cited

U.S. PATENT DOCUMENTS 4,669,450 A * 6/1987 Lindberg ..... A61H 1/0266 482/80
5,001,739 A * 3/1991 Fischer ..... A61G 13/0036 378/195
5,046,487 A * 9/1991 Scott ..... A61G 7/0755 128/DIG. 15
5,421,822 A * 6/1995 Wang ..... A61F 5/0111 602/27
5,584,303 A * 12/1996 Walle ..... A61F 5/01 128/882
5,603,692 A * 2/1997 Maxwell ..... A61F 5/0585 128/882
5,611,770 A * 3/1997 Tesch ..... A61H 1/0266 482/131
5,687,742 A * 11/1997 Johnson ..... A61F 5/0585 482/907
5,713,591 A * 2/1998 Zarkhin ..... A61G 5/12 248/118.3
5,725,486 A * 3/1998 Engelman ..... A61F 5/0585 128/882
5,790,998 A * 8/1998 Crescimbeni ..... A61G 7/0755 128/882
5,878,748 A * 3/1999 Garth ..... A61F 5/0585 128/869
6,110,078 A * 8/2000 Dyer ..... A61H 1/0266 482/121
6,280,404 B1 * 8/2001 Morinaka ..... A61F 5/0102 602/16
6,935,992 B2 * 8/2005 Gehrke ..... A47C 20/021 482/100
7,118,544 B2 * 10/2006 Murray ..... A47C 20/021 5/650
8,715,362 B2 5/2014 Reiley
D707,833 S * 6/2014 Waugh ..... D24/190
8,771,213 B2 * 7/2014 Wens ..... A61F 5/0585 128/882
2004/0030275 A1 * 2/2004 Morinaka ..... A61F 5/0125 602/27
2006/0150337 A1 * 7/2006 Torres ..... A47C 20/021 5/648
2006/0185090 A1 * 8/2006 Jackson ..... A61G 7/001 5/621
2007/0294829 A1 * 12/2007 Callahan ..... A61G 7/065 5/636
2010/0263129 A1 * 10/2010 Aboujaoude ..... A61F 5/3761 5/650
2011/0085876 A1 4/2011 Wagner
2012/0130434 A1 * 5/2012 Stemniski ..... A61B 17/15 606/300
2014/0020690 A1 * 1/2014 Triplett ..... A61G 13/125 128/845

* cited by examiner

SURGICAL SUPPORTING DEVICE FOR THE ALIGNMENT OF THE FOOT, ANKLE, LEG, KNEE, THIGH AND FULL LEG

BACKGROUND

Currently, alignment methods such as those of a "protractor" type are used, even though the alignment method is ambiguous and leaves margin to error considering that the alignment continues to be visual.

The alignment of the lower extremities of the patient is mainly carried out by the surgeon's assistant using his bare hands, and the final angles necessary to fix some of the bones are measured with devices such as transporters, but the alignment is measured visually and it is very easy to overlook the final angle mainly because the desired final angle of the foot's sole vs. leg is 90 degrees, and an alignment with the tibia bone produces an angle greater than 105 degrees.

Patents US20100263129 and US830302228 owned by Emad Aboujaoude refer to a leg-foot fastening device oriented to align the foot and the leg not allowing any movement. However, the device described in the present disclosure is mainly focused on fastening the leg to the operating table and fastening the foot so that the surgeon can carry out the surgical procedure.

Differing from the above mentioned documents, the present disclosure includes the following:

The section that holds the leg (main piece (1)) has the ability to align the device parallel to the center of gravity and the weight's line of thigh, knee and leg, by having a free space to let the calf muscle outside of the supporting line leg-device.

The section that fastens the foot (secondary piece (2)) comprises a free space at its center which—once that the foot is rightly aligned in the desired angle—, allows the ankle to be drilled with an intramedullary nail through the mentioned space and at the same time allows the surgeon to maneuver or reach the bones of the foot's sole.

SUMMARY

The present invention refers to a supporting device for surgical procedures on foot, ankle, knee, thigh and whole leg, where such device comprises three pieces, one of them to provide support to the whole leg, wherein such piece presents an orifice at the leg's calf level which allows said calf to be introduced through the orifice so that the leg is completely supported and aligned parallel to the main piece, a second piece which supports on at least three specific points of the foot's sole, with the characteristic that this secondary piece comprises a space that allows the surgeon to board/drill the calcaneus bone for those surgeries that require an intramedullary nail to be placed through the calcaneus bone, and a third angular piece which has an L-shape with a 90 degree angle to allow the surgeon to align the main piece and the secondary piece when the surgery is being performed.

DETAILED DESCRIPTION OF THE INVENTION

Figure 1:
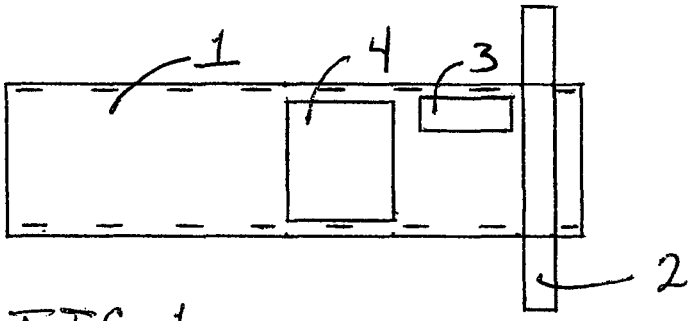
FIG. 1 is an upper view of the supporting surgical device where all its parts may be seen.
Figure 2:
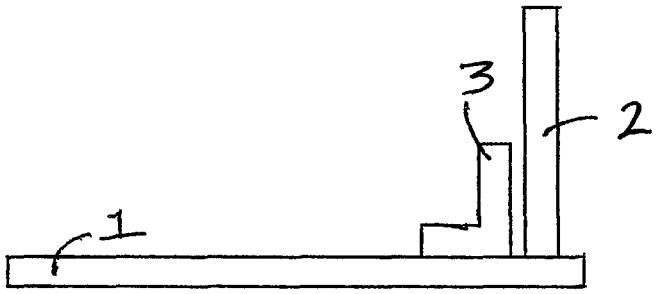
FIG. 2 is a side view of the supporting surgical device where it can be seen how the main piece (1) and the secondary piece (2) are aligned with the help of the angular piece (3).
Figure 3:
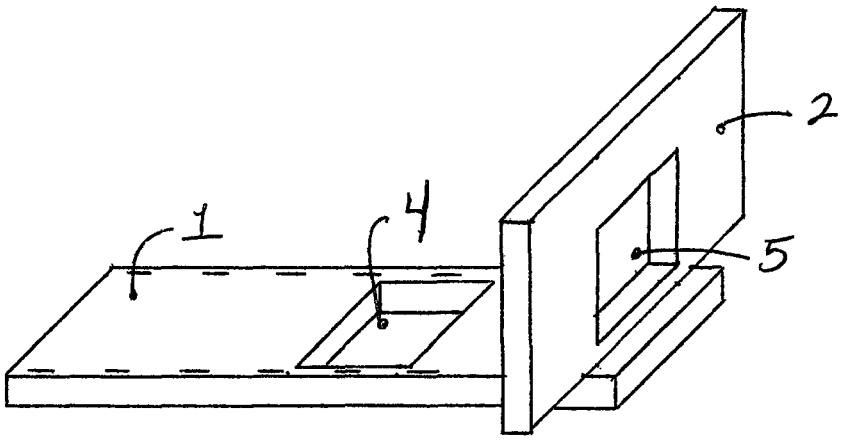
FIG. 3 is a perspective view of the surgical supporting device illustrating the main piece (1) and its orifice (4) where the calf muscle may be placed and the secondary piece (2) and its orifice (5), wherein the foot boards, both pieces being aligned forming an angle of 90°.
Figure 4:
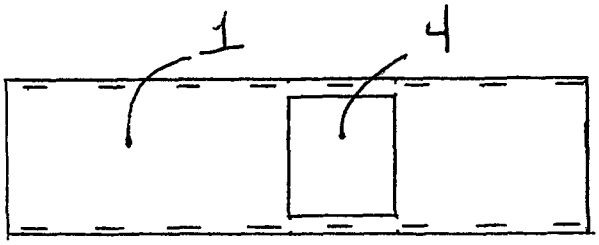
FIG. 4 is an upper view of the main piece (1) where the orifice (4) that aligns to the height of the leg's calf muscle may be seen.
Figure 5:
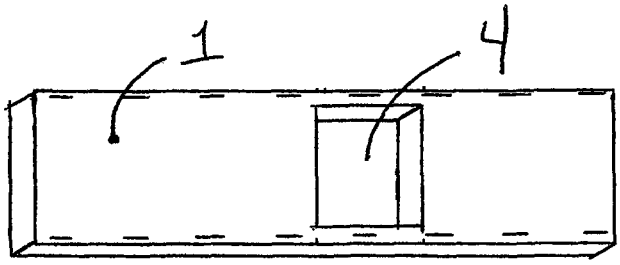
FIG. 5 is an isometric view of the main piece (1) that illustrates the orifice (4) where the leg's calf muscle is introduced in order to allow the proper alignment of the leg.
Figure 6:
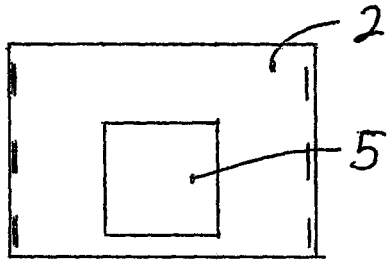
FIGS. 6 and 7 are isometric upper views of the secondary piece (2) where the orifice (5) or supporting space can be observed, that is to be aligned with the foot's sole so as to allow surgical boarding.
Figure 7:
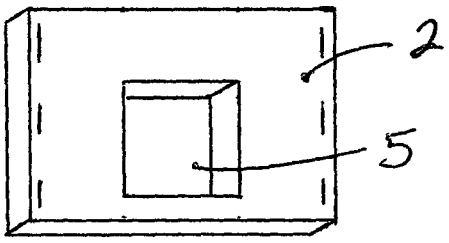
Figure 8:
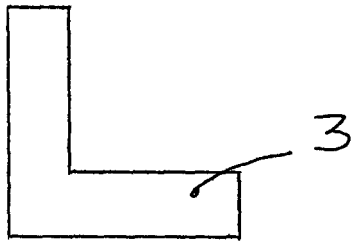
FIGS. 8 and 9 are isometric lateral views of the angular piece (3) squarely shaped which is used as a referent point to align the reference pieces (1) and (2) in a determined angle.
Figure 9:
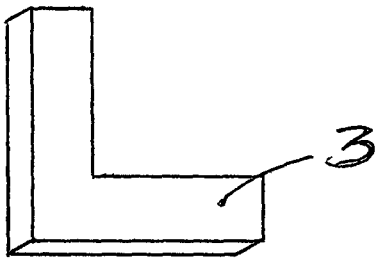

In order to describe the purpose of this invention all human and/or living being will be referred to as patient.

The device comprises 3 parts which may act jointly or separately depending on the surgeon's decision or needs. These pieces can be manufactured in any rigid material that can stand a full leg's weight as well as the foot without being deformed and/or allowing a slight deformation. Such material may be acrylic, plastic, stainless steel, wood or any other material with similar characteristics of the above mentioned materials. Moreover, it must be malleable enough so as to allow perforation or modification, with the aim to obtain a final piece which may have or not have perforations that will allow to use a mechanism to fasten the leg (main piece (1)) or foot (secondary piece (2)), and at the same time will allow to make the necessary perforations to obtain the necessary space for the leg's calf muscle in case of the main piece (1), and perforations for the foot's sole to obtain the necessary space to let the calcaneus free up to the first and fifth metatarsal approximately, for the secondary piece (2). Moreover, if so required, perforations can be included in the lateral extremes of the pieces to implement mechanisms to fasten thigh, knee, leg and foot as it would correspond.

The functioning of each one of the device's parts is as follows:

Main Piece (1): it is the support of the full leg, is the piece that holds the complete leg including the upper thigh, knee, ankle and foot. It is completely flat on both sides with the purpose of assuring a correct angle of the full leg vs. the foot and/or the foot's sole, where such main piece will have a dimension similar to the length of a patient's leg and which will have an orifice (4) at the extreme closest to the ankle in order to allow the calf muscle to be placed unleveled inside of said orifice. Such main piece comprises a periphery with orifices to introduce the holding forms such as elastic bands or Velcro which help maintain the leg steady.

This main's piece objective is to hold the full leg in such a way that the main piece (1) may be maintained parallel to the weight line or/line of gravity of the full leg or body.

A center line of weight in relation to a gravity center: when seeing the balanced human body at a standing position, it may be observed that the above mentioned line of weight is a line that goes from the shoulders, through the center of gravity, pelvis and goes through the back of the upper thigh, comes near the back of the knee and continues directly to the ankle (e.g. perpendicular to the floor). This center line of weight goes through the middle of the calf muscle in reaching the ankle and then the heel, where the main support of the foot is located.

Orifice (space) (4) for the calf muscle: such piece has an orifice (space) (4) at the calf muscle's height, with the function to allow the calf muscle to go through and avoid physical interference with the piece so that the rest of the leg may be placed on the main piece (1); depending on the patient's physique this orifice may allow the leg to go through it, as long as it lets the calf muscle to go through the piece, which is unleveled with respect to the rest of the leg, and allows the rest of the leg to maintain contact and/or be placed on the surface of the piece with the purpose of maintaining the piece aligned in a parallel form to the line of weight. Analogously, the dimensions of this orifice (space) (4) can be variable depending on the patient's physique, and the orifice can be fixed or retractable as the surgeon deems convenient.

Piece setting: The piece must be placed exactly where the gluteus muscle ends and the leg begins, since the gluteus and the calf muscles are traction muscles that are not parallel to the above mentioned line of weight or center of gravity.

When holding up the thigh, knee, leg and foot this piece will allow the calf muscle go through the orifice (space) (4), and thus resulting in the whole leg being parallel to its line of weight or gravity center, and thus parallel to the contact surface of the piece, thus achieving to offer support to the leg whereas such piece is parallel to the line of weight, in order to be able to use it as a reference when it comes to align the foot for the surgical procedure—if necessary—, this way achieving the desired objective.

Dimensions: dimensions may vary for each patient depending on the length of the full leg and the calf muscle size. Thus, the length, width and thickness of the piece may vary depending on each patient. Therefore, the structure of this piece (1) has a retractable modality, using a mechanism to expand and contract the piece to be adjusted to the patient's leg dimensions, and at the same time the orifice (space) (4) must be sufficient so that the calf muscle can be placed out of level with respect to the leg.

Secondary piece (2): the secondary piece is a foot support, and it is the piece that is held against the foot's sole and the one the alignment of the foot with respect to the leg is realized with, thus locating the foot on the surgeon's desired angle. The desired or predetermined angle is usually 90° between foot's sole vs. full leg.

This secondary piece (2) comprises a preferably flat surface on both sides with the purpose to make the angle formed with this piece with respect to the main piece (1) clearly visible and easy to measure. Moreover, it comprises a central orifice (space) (5) that allows the boarding of the foot's sole bones from the base of the calcaneus up to the metatarsals.

Foot's support plane or contact of the secondary piece (2) contact with the foot: the foot has 3 supporting points that are composed by the calcareous bone and the first and fifth metatarsals. The plane formed by the union of these 3 supporting points is what is called the weight line of the foot, and this support plane is the one which normally requires to be aligned with the leg or full leg.

The section of this second piece (2) that is supported over the calcaneus bone must be of such width that it may allow reaching or boarding for the drilling of the calcaneus bone in its base for those surgeries in which an intramedullary nail in the calcaneus is required.

Orifice (space) (5) central to board: The central space of this secondary piece (2) is sufficient for this piece to make enough pressure and/or to allow it to be placed by touching the holding up plane of the foot that is formed by the three supporting points above mentioned, the orifice dimensions (5) (the space to board) varies for each patient depending on the length of the foot, so that the width, length and thickness of the orifice should/can vary depending on each patient. That is the reason why this piece can be mobile (retractable) depending on the requirements of the operations or as well as on the patient's physique, and so dimensions of the orifice (5) and/or the secondary piece (2) may/should vary.

Placement: the secondary piece (2) is supported on the first part of the foot at the heel's level, precisely the calcaneus bone where the body's weight is held upon. Successively the weight is supported on the next two points that complete the supporting line of the foot (i.e., the first and fifth metatarsals), thus achieving a complete parallel alignment between the secondary piece (2) and the plane drawn by the mobile or fixed (retractable) line depending on the operation's requirements and the patient's complexity that may and/or should change the mentioned dimensions.

Secondary Piece (2):

Dimensions: the piece that is placed over the calcaneus bone must be of a width that it may allow boarding for the drilling of the calcaneus bone on those surgical procedures where an intramedullary nail in the calcaneus bone is required. The dimensions of the rest of the secondary piece (2) may vary for each patient depending on the length of the foot and the distance between the three supporting points of the foot, thus, the length, width and thickness of each piece can and/or may vary depending on each patient, that the reason why this piece (2) can be retractable depending on the surgeon's needs and the patient's physique, which can and/or may vary the mentioned dimensions.

Angular Piece (3): it is an L shaped piece with a 90° angle, with all the plane surfaces in a straight angle. This piece is placed over the main piece (1) so as to form a straight angle, it moves over the main piece (1) until it reaches the secondary piece (2) and in this way it allows to determine the angle difference formed by the main piece (1) vs. the secondary piece (2) vs. the angular piece (3) which is manufactured in 90 degrees.

Angular Piece (3): it is an L shaped implement or piece with a 90° angle, with all the plane surfaces in a straight angle. This piece is placed over the main piece (1) so as to form a straight angle, it moves over the main piece (1) until it reaches the secondary piece (2) and in this way it allows to determine the angle difference formed by the main piece (1) vs. the secondary piece (2) vs. the angular piece (3) which is manufactured in 90 degrees.

The invention claimed is:

1. A surgical support device comprising:

a main leg piece for supporting a leg of a patient in parallel with a center line of weight of the patient, the main leg piece shaped with a shaped hole fully extending through a depth of the main leg piece and configured to be aligned with a substantial entirety of a calf muscle of the leg to direct the calf muscle to pass through the main leg piece and enhance the supporting of the leg in parallel with the center line of weight of the patient; and a secondary foot piece extending from said main leg piece and spaced apart from said shaped hole to orient a foot of the patient at about 90° relative the main leg piece.

2. The surgical support device of claim 1 wherein the secondary foot piece is positionally adjustable relative the main leg piece in attaining the 90° orientation.

3. The surgical support device of claim 1 wherein a size of the shaped hole is adjustable to accommodate calf muscles of differing physiques.

4. The surgical support device of claim 1 further comprising an angular implement positioned on the main leg piece to provide visual comparison of any angular difference between the main leg piece, the secondary foot piece and 90°.

5. The surgical support device of claim 1 wherein the main leg piece comprises a plurality of orifices to accommodate fastening mechanisms for securing the leg thereat.

6. The surgical support device of claim 1 wherein the main leg piece is of a rigid material sufficient to support a weight of the leg.

7. The surgical support device of claim 1 wherein the secondary foot piece defines a space to provide a surgeon with surgical access to the foot.

8. The surgical support device of claim 1 wherein the secondary foot piece is of a material selected from a group consisting of acrylic and plastic.

9. A surgical method comprising:

providing a main leg piece of a surgical support device, the main leg piece shaped with a shaped hole fully extending through a depth of the main leg piece and the device further including a secondary foot piece extending from said main leg piece and spaced apart from said shaped hole;

positioning a leg of a patient on the main leg piece with a substantial entirety of a calf muscle of the leg passing through the space provided by said shaped hole to ensure that the main leg piece is parallel in line with a center line of weight of the patient; and aligning a foot of the leg with the secondary foot piece of the surgical support device for orienting the foot at about 90° relative the main leg piece.

10. The surgical method of claim 9 wherein the aligning comprises:

placing the secondary foot piece on the main leg piece adjacent the foot; and advancing the secondary foot piece on the main leg piece toward the foot to attain the orienting.

11. The surgical method of claim 9 wherein the aligning comprises interfacing the foot with the secondary foot piece at locations adjacent calcaneus and metatarsal bones of the foot.

12. The surgical method of claim 11 further comprising drilling through the calcaneus bone via an orifice of the secondary foot piece.

13. The surgical method of claim 12 further comprising installing a nail through the calcaneus bone.

14. The surgical method of claim 9 further comprising referencing an angular implement on the main leg piece to confirm the orienting of the foot.

15. A surgical support assembly comprising:

a main leg piece for supporting a leg of a patient in parallel with a center line of weight of the patient, the main leg piece shaped with a shaped hole fully extending through a depth of the main leg piece and configured to be aligned with a substantial entirety of a calf muscle of the leg to direct the calf muscle to pass through the main leg piece and enhance the supporting of the leg in parallel with the center line of weight of the patient; and a secondary foot piece extending from said main leg piece and space apart from said shaped hole to forcibly orient the foot at a predetermined angle relative the main leg piece and the center line of weight of the patient.

16. The surgical support assembly of claim 15 further comprising an angular implement on the main leg piece to confirm the foot at about the predetermined angle.

17. The surgical support assembly of claim 15 wherein the predetermined angle is about 90°.

18. The surgical support assembly of claim 15 wherein the secondary foot piece defines a space to provide a surgeon with surgical access to the foot.

* * * * *